US007746323B1

(12) United States Patent
Otsuki et al.

(10) Patent No.: US 7,746,323 B1
(45) Date of Patent: Jun. 29, 2010

(54) 5-DIRECTIONAL KEY OPERATION DEVICE

(75) Inventors: Susumu Otsuki, Yamato (JP); Mamoru Yoshida, Yokosuka (JP); Teruo Nanmoku, Kanagawa (JP); Toshiyasu Kitamura, Yokohama (JP); Akinori Ohira, Yokohama (JP); Koichi Yamamoto, Yokohama (JP)

(73) Assignee: Panasonic Corporation, Osaka (JP)

( * ) Notice: Subject to any disclaimer, the term of this patent is extended or adjusted under 35 U.S.C. 154(b) by 236 days.

(21) Appl. No.: 09/857,155

(22) PCT Filed: Sep. 28, 2000

(86) PCT No.: PCT/JP00/06736

§ 371 (c)(1),
(2), (4) Date: May 31, 2001

(87) PCT Pub. No.: WO01/26126

PCT Pub. Date: Apr. 12, 2001

(30) Foreign Application Priority Data

Oct. 1, 1999 (JP) ..... P.11-281740
Oct. 1, 1999 (JP) ..... P.11-281741

(51) Int. Cl.
*G09G 5/00* (2006.01)

(52) U.S. Cl. ..... 345/169; 379/433.07

(58) Field of Classification Search ..... 345/156–173; 341/20, 22; 361/680; 400/472, 489; 200/330; 379/433.07

See application file for complete search history.

(56) References Cited

U.S. PATENT DOCUMENTS 5,959,863 A * 9/1999 Hoyt et al. ..... 700/85
6,274,825 B1 * 8/2001 Aaltonen et al. ..... 200/5 A
2002/0067343 A1 * 6/2002 Anderson ..... 345/168
2002/0080186 A1 * 6/2002 Frederiksen ..... 345/808

(Continued)

FOREIGN PATENT DOCUMENTS

CN 1180915 A 5/1998

(Continued)

OTHER PUBLICATIONS

Japanese Office Action 1.

(Continued)

*Primary Examiner*—Nitin Patel
(74) *Attorney, Agent, or Firm*—Pearne & Gordon LLP

(57) ABSTRACT

A 5-direction key operating device is provided in which the structure of diaphragm contacts disposed on a printed circuit board is improved to allow five diaphragms to be disposed in a minimum space, and a single button key is enabled to operate the five diaphragms. Moreover, a 5-direction key operating device is provided in which an operation space can be reduced, and desired one of information displayed on a display section can be selected and determined by a smooth key operation without causing an erroneous operation.

In each of diaphragm contacts on which diaphragms (4) that are arranged in the shape of a cross in correspondence with 5-direction keys are to be placed, a circular contact (1) which is a first contact, and strip-like contact portions (3*a* to 3*d*) which are elongated in a fan-like shape with respect to the center of the first contact (1) are disposed in a second contact (2) and in the side opposite to the side of the first contact (1). According to this configuration and arrangement, the space for disposing the diaphragm contacts can be reduced, and the whole device can be miniaturized and lightened. Five diaphragms are shown on the printed circuit board, and five pusher portions are disposed on a core face opposed to the diaphragms and on a key base. The height of the upper, lower, right, and left pusher portions is set to be different from that of the center pusher portion.

16 Claims, 15 Drawing Sheets

FOREIGN PATENT DOCUMENTS

| | | | | |
|---|---|---|---|---|
| JP | 04-2424 | U | | 1/1992 |
| JP | 08-096665 | A | | 4/1996 |
| JP | 8-241647 | | | 9/1996 |
| JP | 02000156133 | A | * | 11/1998 |
| JP | 11-126126 | | | 5/1999 |
| JP | 11-149848 | A | | 6/1999 |

OTHER PUBLICATIONS

Japanese Office Action 2.

* cited by examiner

5-DIRECTIONAL KEY OPERATION DEVICE

TECHNICAL FIELD

The present invention relates to a 5-direction key operating device for a portable telephone or the like which includes a PHS (Personal Handyphone System), and particularly to a configuration in which the structure of diaphragm contacts disposed on a printed circuit board is improved to allow diaphragms to be disposed in a minimum space, and the same button key is enabled to perform key operations of five directions (upper, lower, right, and left+center), and more particularly to a configuration in which a rubber base of a key core face is improved so that the same operation button is enabled to smoothly perform key operations of five directions (upper, lower, right, and left+center) without causing an erroneous operation.

BACKGROUND ART

Conventionally, a 5-direction key operating device such as shown in FIG. 17 is known. In the main unit 500 of a portable telephone, a display section 501 such as a liquid crystal display device (LCD), and an operation section 502 in which various keys are arranged are disposed. The operation section 502 is configured by: a first portion consisting of cursor-movement keys 503 and an enter key 504; and a second portion consisting of ten keys, menu keys, and other keys 505. Among them, the first portion constitutes a 5-direction key operating device.

The five directions mean the upward, downward, rightward, and leftward directions (see triangular arrows in the figure), and the central direction. Usually, a cursor is moved among instruction displays on the display section 501 by operating keys of the forward, rearward, rightward, and leftward directions, i.e., the cursor-movement keys 503, and the instruction display to which the cursor is moved is determined by operating the central direction key, i.e., the enter key 504.

In the conventional 5-direction key operating device described above, the four cursor-movement keys 503 and the one enter key 504 are independently disposed, and hence there are problems in that a substantially large space is required for placing these keys, and that, when the keys are to be actually operated, the movement range of a specific finger is widened and the time period for the operation is correspondingly prolonged.

Therefore, a portable telephone or the like may be contemplated in which, as shown in FIG. 18, ten keys 631 and the like are formed integrally with a key sheet 630 made of silicon rubber or the like, and the assembly is attached to a predetermined position of a cover 610, and placed so as to be opposed to diaphragms 604 disposed on a printed circuit board 640.

In such a portable telephone, the 5-direction key operating device is configured by a 5-direction key 606 which is the largest key standing on the key sheet 630, and the diaphragms 604 which correspond thereto, and which are arranged in the shape of a cross.

In a design by those skilled in the art, as contacts on which the diaphragms 604 that are arranged in the shape of a cross in accordance with the 5-direction key 606 are to be placed, it is usual to design so that doughnut-shaped contacts such as shown in FIG. 19, i.e., first contacts 601 and second contacts 602 are disposed on the printed circuit board 640 and predetermined diaphragms 604 are placed thereon.

In this design, with respect to the space for disposing the diaphragm contacts, however, there is no choice other than that the minimum space is formed by placing the second contacts 602 to be placed as close as possible to the limit where the contacts are not in contact with each other.

Therefore, it is a first object of the invention to provide a 5-direction key operating device in which the structure of diaphragm contacts disposed on a printed circuit board is improved to allow five diaphragms to be disposed in a minimum space, and the five diaphragms can be operated by one button key.

It is also a second object of the invention to provide a 5-direction key operating device in which an operation space can be reduced, and desired one of information displayed on a display section can be selected and determined by a smooth key operation without causing an erroneous operation.

DISCLOSURE OF INVENTION

A 5-direction key operating device relating to the first object is a 5-direction key operating device in which diaphragms respectively corresponding to five directions are proximately arranged in a shape of a cross, which comprises pushers corresponding to the five directions on a key core face opposed to the diaphragms, and in which a single key is enabled to perform key operations of the five directions, and characterized in that each of diaphragm contacts which are disposed on a printed circuit board opposed to the diaphragms is structured to have a first contact, and at least one second contact surrounding the first contact, at least one strip-like contact portions which are elongated from the second contact to a side opposite to a side of the first contact are disposed in the second contact, and the diaphragm contacts are arranged on the printed circuit board in a shape of a cross correspondingly with the five directions with tilting the strip-like contact portions of the diaphragm contacts by about 45 degrees to vertical and horizontal directions.

Preferably, the strip-like contact portions may be elongated in a fan-like shape with respect to a center of the first contact.

Preferably, the strip-like contact portions may be rectangular.

A 5-direction key operating device relating to the second object is characterized in that five diaphragms are proximately arranged in a shape of a cross, pusher portions are disposed on a key core face opposed to the diaphragms, and a structure of a center pusher portion is different from a structure of pusher portions surrounding the center pusher portion, whereby a single key is enabled to smoothly perform operations of five directions without causing an erroneous operation.

In the 5-direction key operating device, a height of the center pusher portion from the diaphragm may be different from a height of the surrounding pusher portions from the respective diaphragms, whereby the single key is enabled to smoothly perform operations of five directions without causing an erroneous operation.

In the 5-direction key operating device, a shape of the center pusher portion may be different from a shape of the surrounding pusher portions, whereby the single key is enabled to smoothly perform operations of five directions without causing an erroneous operation.

In the 5-direction key operating device, a cross-sectional diameter of the center pusher portion may be different from a cross-sectional diameter of the surrounding pusher portions, whereby the single key is enabled to smoothly perform operations of five directions without causing an erroneous operation.

In the 5-direction key operating device, one of a rib and a boss may stand from an arbitrary position of the key core face on which the pusher portions exist, whereby the single key is enabled to smoothly perform operations of five directions without causing an erroneous operation.

In the 5-direction key operating device, the five diaphragms may be proximately arranged in a shape of a cross, and a structure of a key skirt portion which is formed in a periphery of the key core face opposed to the diaphragms may be changed, whereby the single key is enabled to smoothly perform operations of five directions without causing an erroneous operation.

In the 5-direction key operating device, one of a width and thickness of the key skirt portion may be changed, whereby the single key is enabled to smoothly perform operations of five directions without causing an erroneous operation.

In the 5-direction key operating device, a shape of the key skirt portion may be changed, whereby the single key is enabled to smoothly perform operations of five directions without causing an erroneous operation.

In the 5-direction key operating device, diaphragms respectively corresponding to operations of five directions may be proximately arranged in a shape of a cross, and a load on a center diaphragm may be changed from loads on surrounding diaphragms, whereby the single key is enabled to smoothly perform operations of five directions without causing an erroneous operation.

In the 5-direction key operating device, the five diaphragms may be proximately arranged in a shape of a cross, and a load on a center diaphragm may be changed from loads on surrounding diaphragms, and pusher portions may be disposed on a key core face opposed to the diaphragms, and a structure of a center pusher portion may be different from a structure of pusher portions surrounding the center pusher portion, whereby a single key is enabled to smoothly perform operations of five directions without causing an erroneous operation.

In the 5-direction key operating device, the five diaphragms may be proximately arranged in a shape of a cross, a load on a center diaphragm may be changed from loads on surrounding diaphragms, and a structure of a key skirt portion which is formed in a periphery of the key core face opposed to the diaphragms may be changed, whereby the single key is enabled to smoothly perform operations of five directions without causing an erroneous operation.

In the 5-direction key operating device, the five diaphragms may be proximately arranged in a shape of a cross, a load on a center diaphragm may be changed from loads on surrounding diaphragms, and pusher portions may be disposed on a key core face opposed to the diaphragms, a structure of a center pusher portion may be different from a structure of pusher portions surrounding the center pusher portion, and a structure of a key skirt portion which is formed in a periphery of the key core face opposed to the diaphragms may be changed, whereby a single key is enabled to smoothly perform operations of five directions without causing an erroneous operation.

BEST MODE FOR CARRYING OUT THE INVENTION

Hereinafter, an embodiment of the invention will be described with reference to FIGS. 1 to 4.

Figure 1:
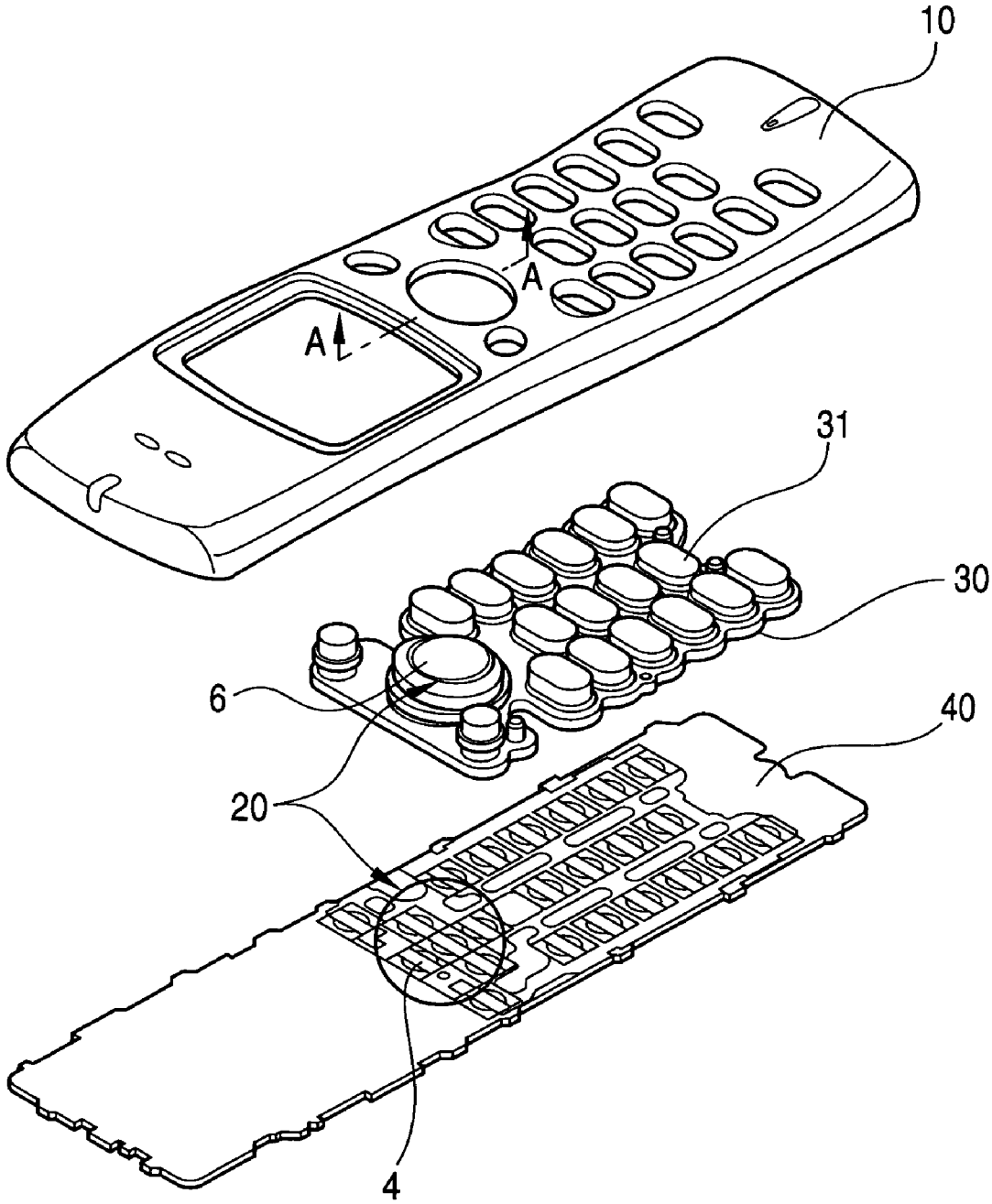
FIG. 1 is a view sowing the configuration of a 5-direction key operating device of a first embodiment of the invention.
Figure 2:
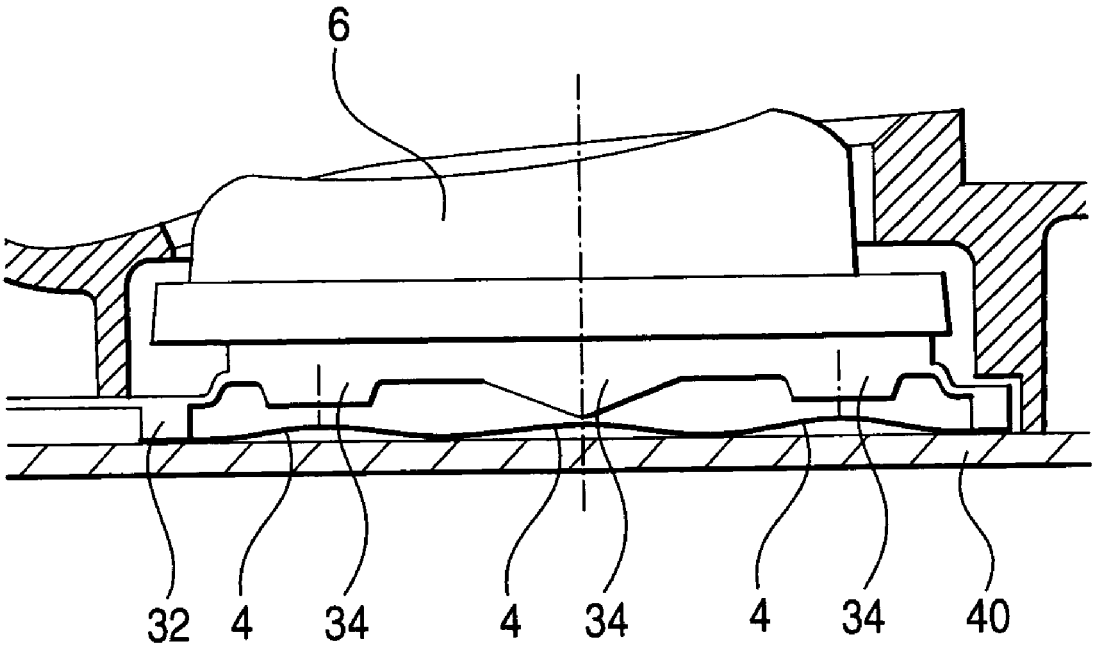
FIG. 2 is a section view taken along the line A-A of FIG. 1 and showing the configuration of the assembled 5-direction key operating device of the embodiment of the invention.
Figure 18:
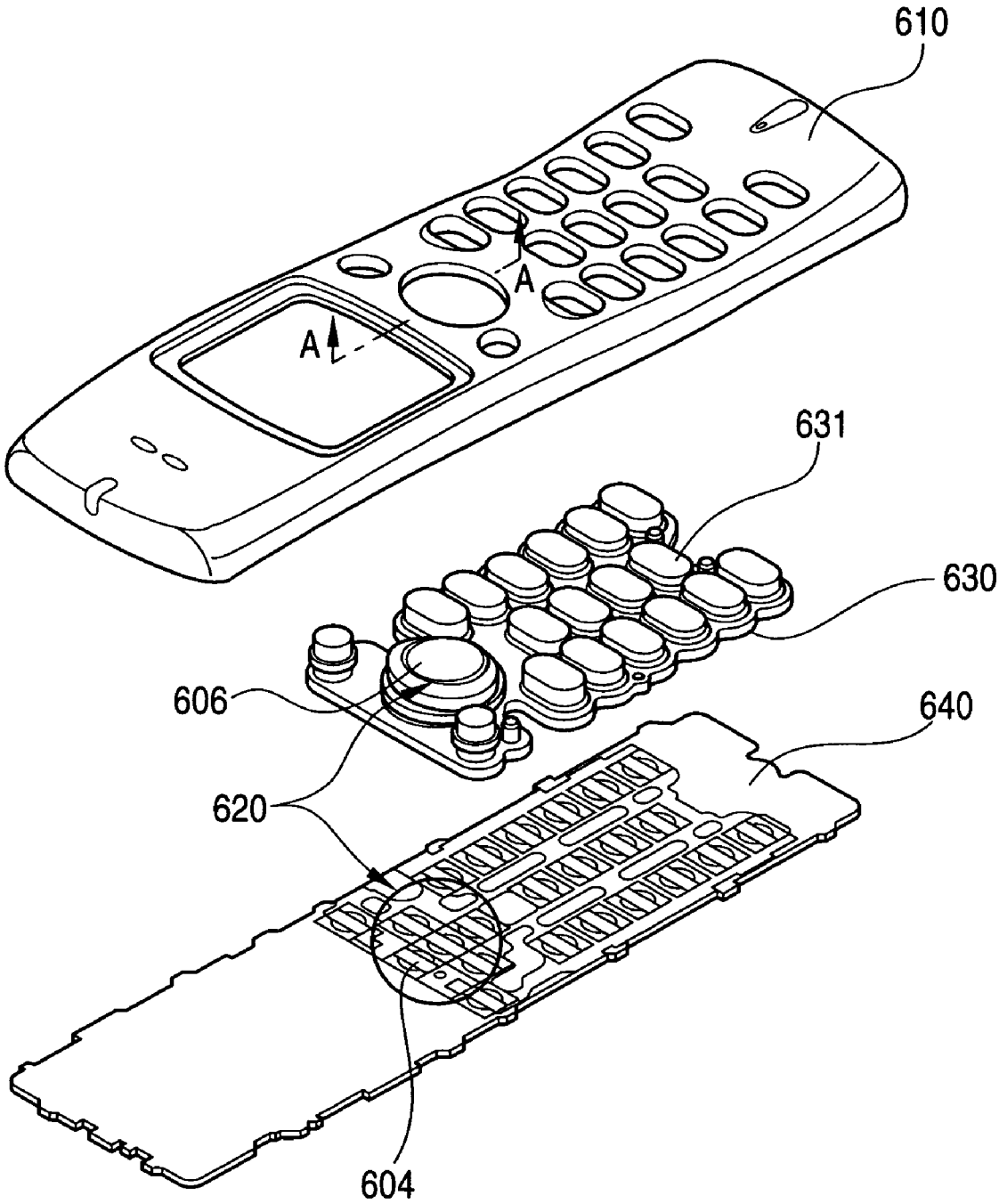
FIG. 18 is a view similar to FIGS. 1 and 5 and showing another configuration of the assembled 5-direction key operating device.

FIG. 1 is an exploded perspective view of a 5-direction key operating device which is an embodiment of the invention, and which is incorporated into a portable telephone or the like, and similar to FIG. 18. FIG. 2 is a section view taken along the line A-A of FIG. 1, after assembled as a portable telephone.

Referring to FIG. 1, in a portable telephone or the like, usually, ten keys 31 and the like are formed integrally with a key sheet 30 made of silicon rubber or the like, and the assembly is attached to a predetermined position of a cover 10, and placed so as to be opposed to diaphragms 4 disposed on a printed circuit board 40.

The 5-direction key operating device of the invention is configured by a 5-direction key 6 which is the largest key standing on the key sheet 30, and the diaphragms 4 which correspond thereto, and which are arranged in the shape of a cross.

FIG. 2 is a section view taken along the line A-A of FIG. 1 and showing the configuration of the 5-direction key operating device of the embodiment of the invention, after assembled as a portable telephone. In FIG. 2, three diaphragms 4 are shown on the printed circuit board 40, and three pushers 34 are disposed on the core face of the 5-direction key 6 opposed to the diaphragms and on a key base 32. The shape of the center pusher (although the section shape is triangular, the center pusher actually has a quadrangular pyramidal shape) is set to be different from that of the right and left pushers (although the section shape is trapezoidal, the pushers actually have a cylindrical shape).

Figure 19:
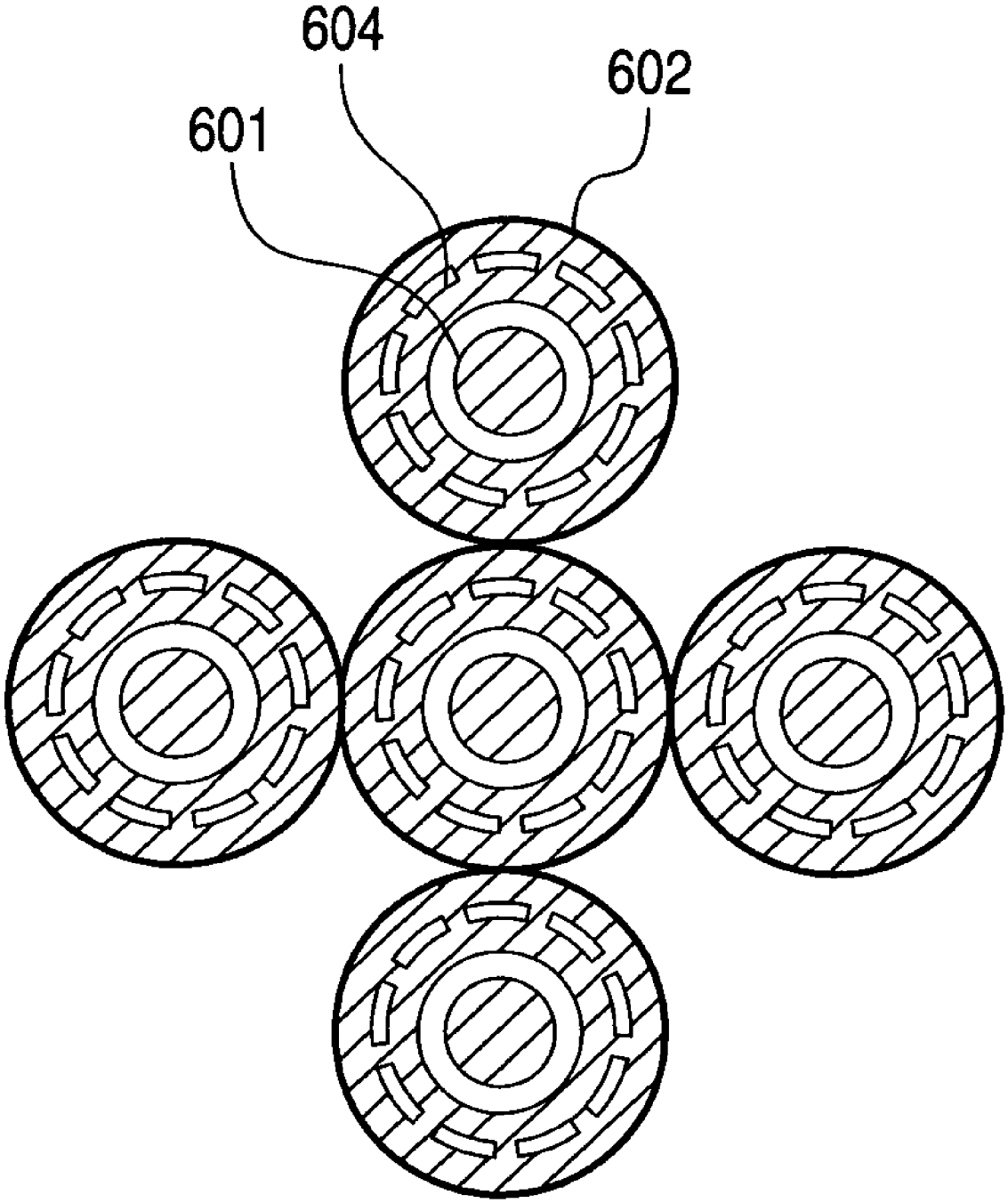
FIG. 19 is a view showing the structure of diaphragm contacts in the 5-direction key operating device of FIG. 18, the diaphragm contacts being arranged in a shape of a cross.

Unlike the conventional design such as shown in FIG. 19, in the invention, the space for disposing diaphragm contacts is further reduced, and second contacts is devised, whereby the whole device can be miniaturized and lightened.

Figure 3:
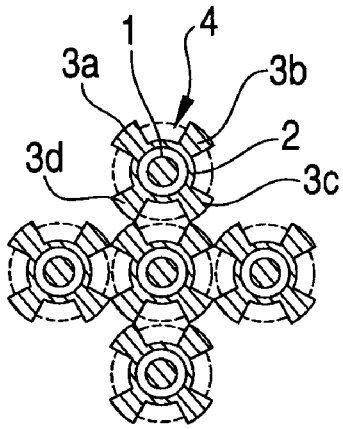
FIG. 3 is a view showing the structure of diaphragm contacts in the first embodiment of the invention, the diaphragm contacts being arranged in a shape of a cross.

FIG. 3 shows the configuration of the diaphragm contacts in the first embodiment of the invention. Referring to FIG. 3, each of the diaphragm contacts has a circular contact 1 which is a first contact, and strip-like contact portions 3*a* to 3*d* which are elongated in a fan-like shape with respect to the center of the first contact 1 are disposed in a second contact 2 and in the side opposite to the side of the first contact 1.

Since a fan-like shape is employed, the area of a metal pattern portion of the second contact 2 is larger as the portion is further separated from the center of the first contact 1. Even when the shape of the outer periphery of the diaphragm 4 is somewhat waved by uneven quality of production, therefore, the outer periphery of the diaphragm 4 is in contact with any one of the many strips, so that conduction can be ensured.

Five diaphragm contacts which are configured as described above are arranged in the shape of a cross so that the strip-like contact portions 3*a* and 3*c*, and the strip-like contact portions 3*b* and 3*d* are tilted by about 45 degrees to the vertical and horizontal directions. According to this configuration, places where there is a fear that the second contacts 2 (actually, the strip-like contact portions 3) are in contact with each other form about 45 degrees. Therefore, the diaphragms 4 can be arranged in close proximity to each other, and the space for disposing the diaphragms can be minimized.

Figure 4:
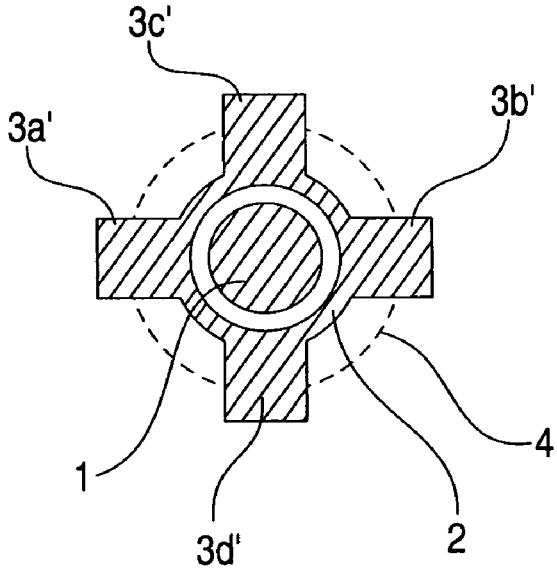
FIG. 4 is a view showing the structure of diaphragm contacts in a second embodiment of the invention.

FIG. 4 shows the configuration of the diaphragm contacts in the second embodiment of the invention. Referring to FIG. 4, each of the diaphragm contacts has a circular contact 1 which is a first contact, and strip-like contact portions 3*a*' to 3*d*' which are rectangular, and which are elongated from the second contact 2 are disposed in the second contact 2 and in the side opposite to the side of the first contact 1.

Five diaphragm contacts which are configured as described above are arranged in the shape of a cross so that the strip-like contact portions 3*a*' and 3*c*', and the strip-like contact portions 3*b*' and 3*d*' are tilted by about 45 degrees to the vertical and horizontal directions in the same manner as described above. According to this configuration, places where there is a fear that the second contacts (actually, the strip-like contact portions 3) 2 are in contact with each other form about 45 degrees. Therefore, the diaphragms 4 can be arranged in close proximity to each other, and the space for disposing the diaphragms can be minimized.

In the above description, the second contacts each of which is formed into a single-doughnut like shape have been illustrated. Alternatively, the device may be configured by disposing a plurality of doughnut-like shapes in each of the diaphragms.

Next, other embodiments of the invention will be described with reference to FIGS. 5 to 16.

Figure 5:
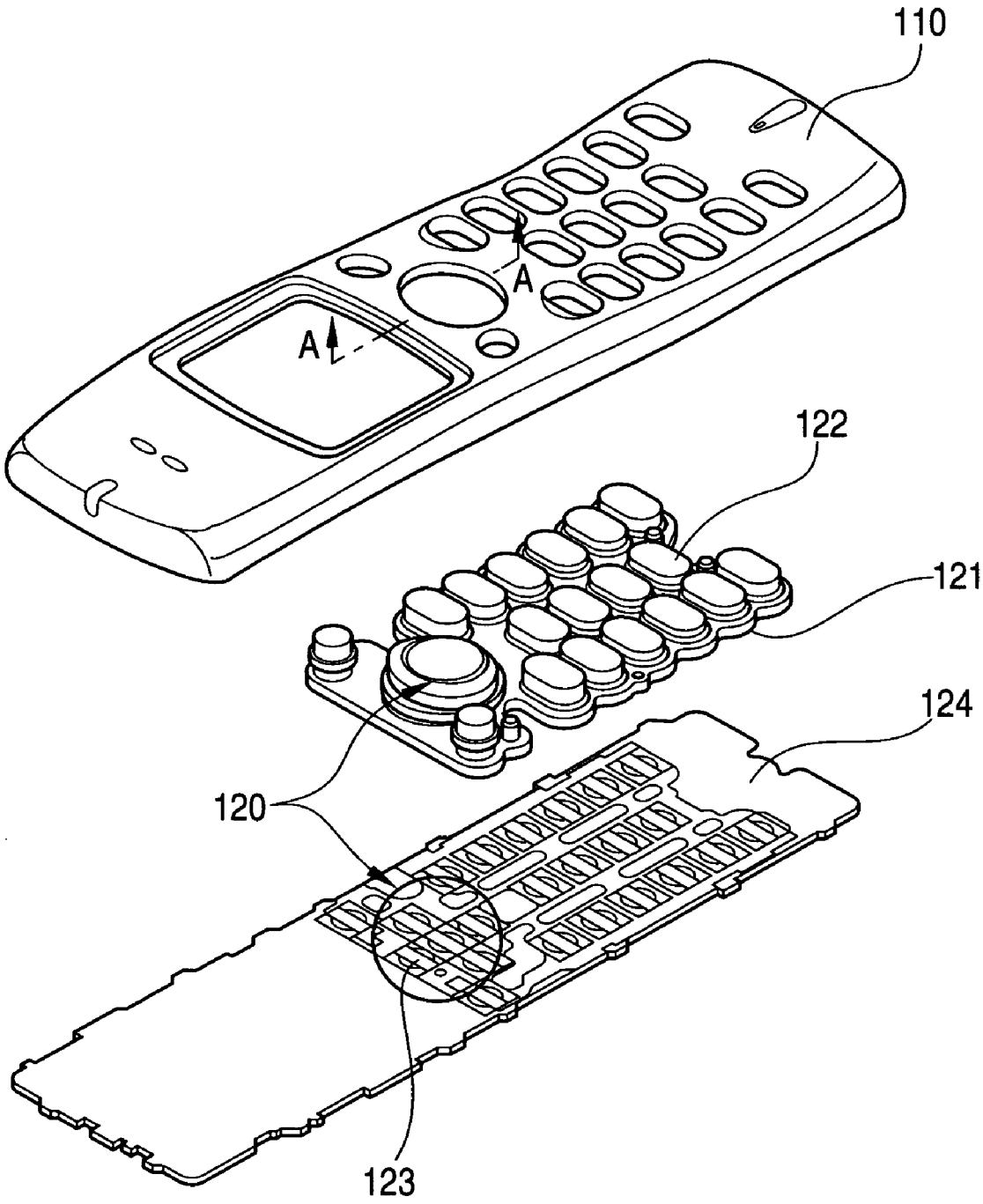
FIG. 5 is a view similar to FIG. 1 and showing the configuration of the assembled 5-direction key operating device of the embodiment of the invention.

FIG. 5 is an exploded perspective view of a 5-direction key operating device which is an embodiment of the invention, and which is incorporated into a portable telephone including a PHS (Personal Handyphone system) or the like, and similar to FIGS. 1 and 18. FIGS. 6 to 15 are section views taken along the line A-A of FIG. 5, after assembled as a portable telephone.

Referring to FIG. 5, in a portable telephone including a PHS or the like, usually, ten keys 122 and the like are formed integrally with a key sheet 121 made of silicon rubber or the like, and the assembly is attached to a predetermined position of a cover 110, and placed so as to be opposed to diaphragms 123 disposed on a printed circuit board 124.

The 5-direction key operating device of the invention is configured by a largest key which is standing on the key sheet 121, and the diaphragms 123 which correspond thereto, and which are arranged in the shape of a cross.

Figure 6:
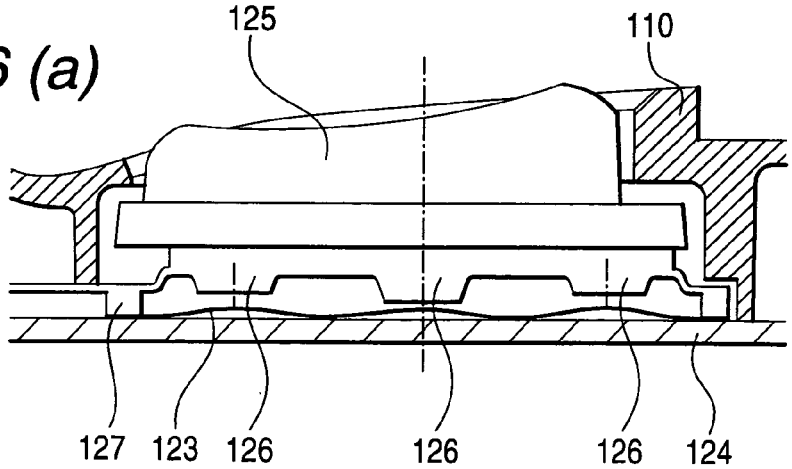
FIG. 6(*a*) is a section view taken along the line A-A of FIG. 5 and showing the configuration of an assembled 5-direction key operating device of a third embodiment of the invention, and FIG. 6(*b*) is a view of a key sheet as viewed from the below.
Figure 6:
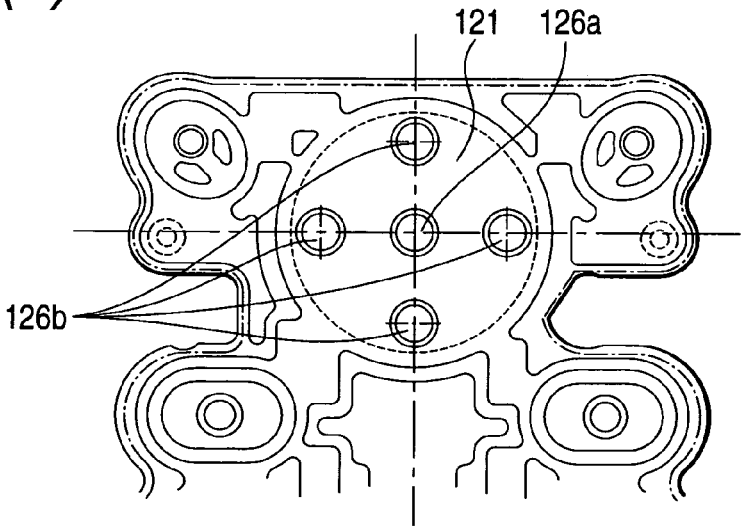

FIG. 6(*a*) is a section view taken along the line A-A of FIG. 5 and showing the configuration of the assembled 5-direction key operating device of a third embodiment of the invention. In FIG. 6(*a*), five diaphragms 123 are shown on the printed circuit board 124, and five pusher portions 126 are disposed on the core face opposed to the diaphragms and on a key base 127. As shown in FIG. 6(*b*) which is a view of the key sheet 121 as viewed from the below, four pusher portions 126*b* are placed in upper, lower, right, and left sides with being centered at the center pusher portion 126. The height of the center pusher portion is set to be larger than that of the upper, lower, right, and left pusher portions.

In the thus configured 5-direction key operating device, although a single key top 125 is disposed, the height of the center pusher portion is different from that of the surrounding pusher portions. Therefore, the pushing sensation experienced when the center pusher portion is pressed is different from that experienced when one of the upper, lower, right, and left pusher portions is pressed. Consequently, the key operation can be smoothly performed without causing an erroneous operation.

Figure 7:
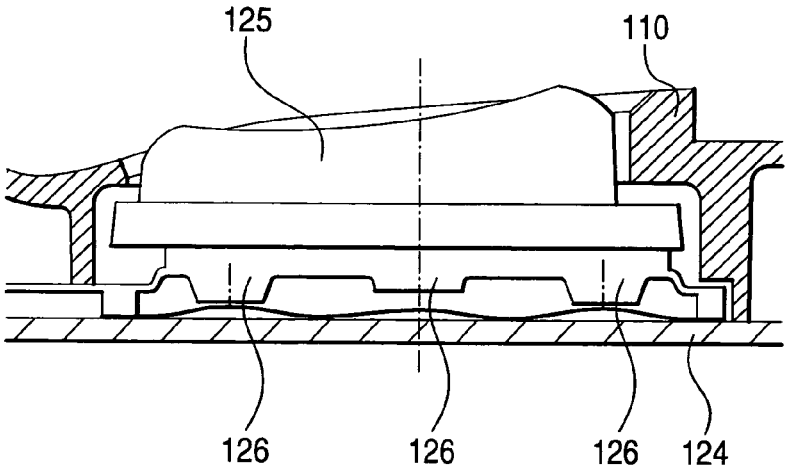
FIG. 7 is a section view taken along the line A-A of FIG. 5 and showing another configuration of the assembled 5-direction key operating device of the third embodiment of the invention.

FIG. 7 is a section view taken along the line A-A of FIG. 5 and showing another other configuration of the assembled 5-direction key operating device of the third embodiment of the invention. The concept is similar to that of FIG. 6(*a*), but, unlike FIG. 6(*a*), the height of the upper, lower, right, and left pusher portions is set to be larger than that of the center pusher portion.

In the thus configured 5-direction key operating device, although a single key top 125 is disposed, the height of the center pusher portion is different from that of the surrounding pusher portions. Therefore, the pushing sensation experienced when the center pusher portion is pressed is different from that experienced when one of the upper, lower, right, and left pusher portions is pressed. Consequently, the key operation can be smoothly performed without causing an erroneous operation.

Figure 8:
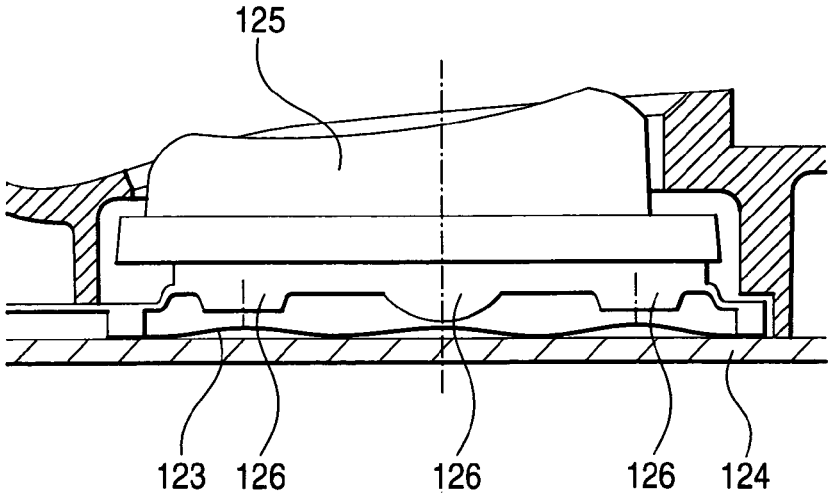
FIG. 8 is a section view taken along the line A-A of FIG. 5 and showing the configuration of an assembled 5-direction key operating device of a fourth embodiment of the invention.

FIG. 8 is a section view taken along the line A-A of FIG. 5 and showing the configuration of an assembled 5-direction key operating device of a fourth embodiment of the invention. The shape (which is identical with that of FIGS. 6(*a*) and 7, or trapezoidal) of the upper, lower, right, and left pusher portions is set to be different from that (unlike FIGS. 6(*a*) and 7, arcuate) of the center pusher portion.

In the thus configured 5-direction key operating device, although a single key top 125 is disposed, the shape of the center pusher portion is different from that of the surrounding pusher portions. Therefore, the pushing sensation experienced when the center pusher portion is pressed is different from that experienced when one of the upper, lower, right, and left pusher portions is pressed. Consequently, the key operation can be smoothly performed without causing an erroneous operation.

Figure 9:
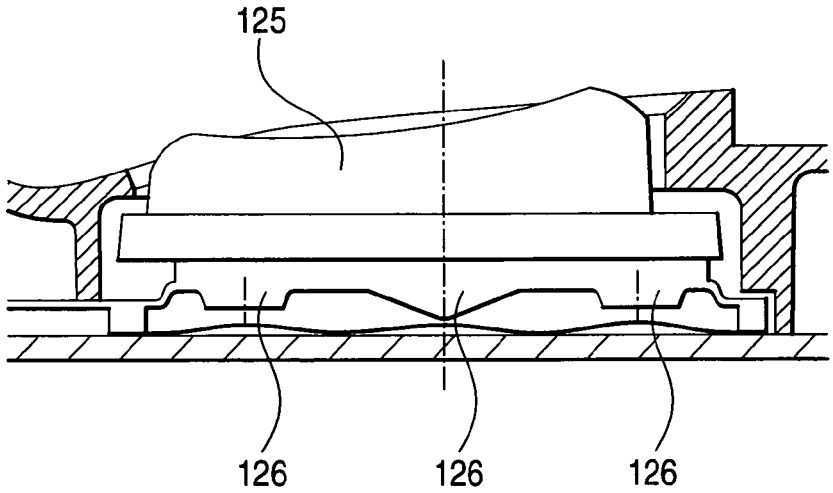
FIG. 9 is a section view taken along the line A-A of FIG. 5 and showing another configuration of the assembled 5-direction key operating device of the fourth embodiment of the invention.

FIG. 9 is a section view taken along the line A-A of FIG. 5 and showing another configuration of the assembled 5-direction key operating device of the fourth embodiment of the invention. Unlike that of FIG. 8, the shape of the center pusher portion is changed from an arcuate one to a triangular one. The other components are set to be identical with those of FIG. 8.

This configuration can attain the same effect as that of FIG. 8, although the pushing sensation is different from that of FIG. 8 because the shape of the center pusher portion is different from that of the center pusher portion of FIG. 8.

Figure 10:
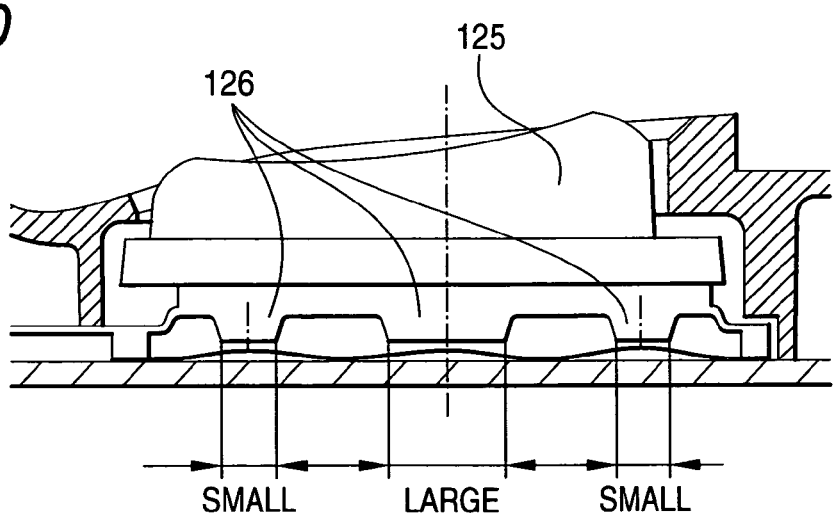
FIG. 10 is a section view taken along the line A-A of FIG. 5 and showing the configuration of an assembled 5-direction key operating device of a fifth embodiment of the invention.

FIG. 10 is a section view taken along the line A-A of FIG. 5 and showing the configuration of an assembled 5-direction key operating device of a fifth embodiment of the invention. The cross-sectional diameter of the center pusher portion which is trapezoidal in the same manner as FIGS. 6(*a*) and 7 is set to be larger than that of the upper, lower, right, and left pusher portions which are trapezoidal in the same manner as FIGS. 6(*a*) and 7.

In the thus configured 5-direction key operating device, although a single key top 125 is disposed, the cross-sectional diameter of the center pusher portion is different from that of the surrounding pusher portions. Therefore, the pushing sensation experienced when the center pusher portion is pressed is different from that experienced when one of the upper, lower, right, and left pusher portions is pressed. Consequently, the key operation can be smoothly performed without causing an erroneous operation.

Figure 11:
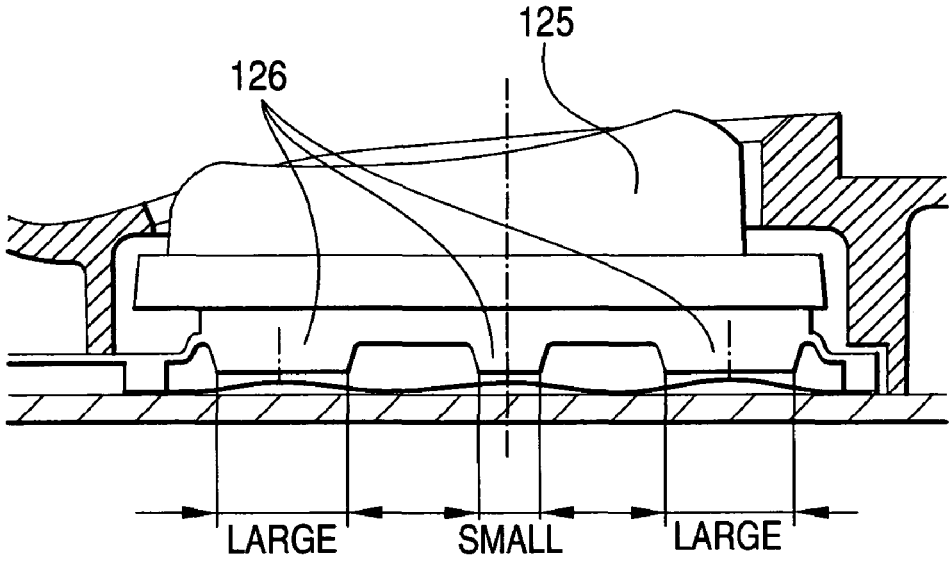
FIG. 11 is a section view taken along the line A-A of FIG. 5 and showing another configuration of the assembled 5-direction key operating device of the fifth embodiment of the invention.

FIG. 11 is a section view taken along the line A-A of FIG. 5 and showing another configuration of the assembled 5-direction key operating device of the fifth embodiment of the invention. Unlike that of FIG. 10, the cross-sectional diameter of the center pusher portion is smaller than that of the upper, lower, right, and left pusher portions.

Since the cross-sectional diameter of the center pusher portion is different from that of the surrounding pusher portions as described above, the pushing sensation experienced when the center pusher portion is pressed is different from that experienced when one of the upper, lower, right, and left pusher portions is pressed, in the same manner as FIG. 10. Consequently, the key operation can be smoothly performed without causing an erroneous operation.

Figure 12:
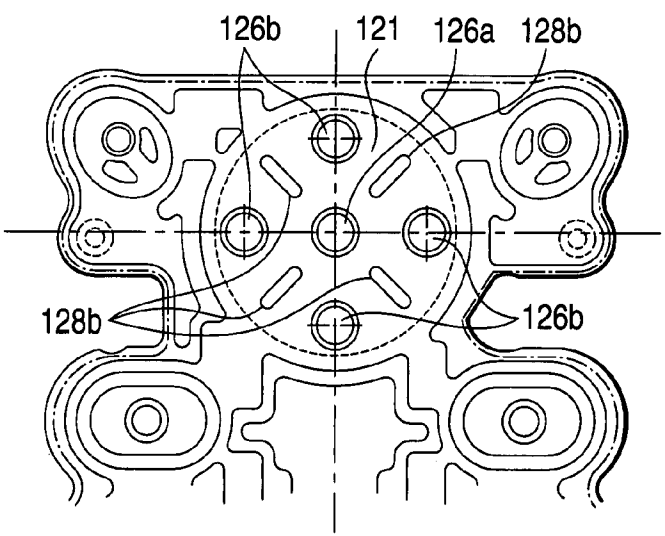
FIG. 12(*a*) is a section view taken along the line A-A of FIG. 5 and showing the configuration of an assembled 5-direction key operating device of a sixth embodiment of the invention, FIG. 12(*b*) is a view of a key sheet as viewed from the below in the case where bosses stand erected, and FIG. 12(*c*) is a view of a key sheet as viewed from the below in the case where ribs stand.
Figure 12:
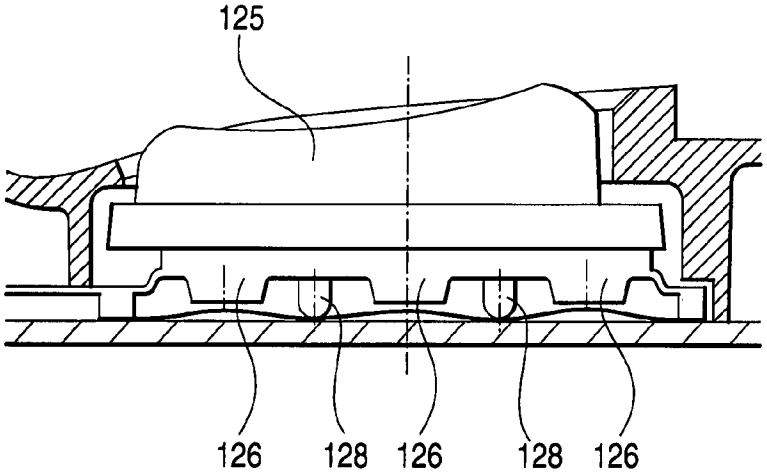
Figure 12:
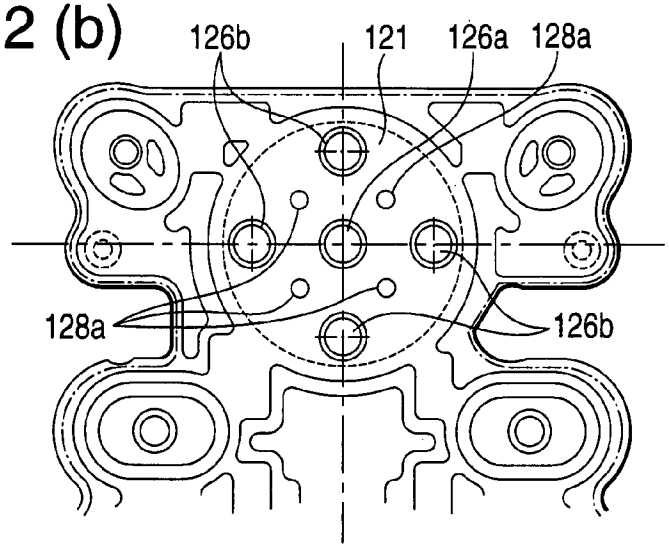

FIG. 12(*a*) is a section view taken along the line A-A of FIG. 5 and showing the configuration of an assembled 5-direction key operating device of a sixth embodiment of the invention. Although the shape of pusher portions 126 is trapezoidal in the same manner as FIGS. 6(*a*) and 7, ribs or bosses 128 stand between the pusher portions 126. As shown in FIG. 12(*b*), four bosses 128*a* are disposed between four pusher portions 126*a* which are placed in upper, lower, right, and left sides, or, as shown in FIG. 12(*c*), ribs 128*b* are disposed. According to this configuration, the pushing sensation experienced when the center pusher portion is pressed is made different from that experienced when one of the upper, lower, right, and left pusher portions is pressed.

Figure 13:
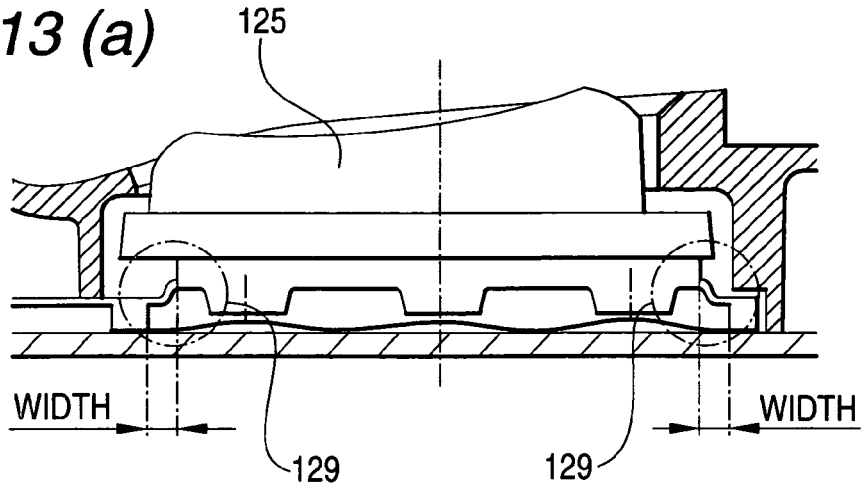
FIG. 13(*a*) is a section view taken along the line A-A of FIG. 5 and showing the configuration of an assembled 5-direction key operating device of a seventh embodiment of the invention, FIG. 13(*b*) is a view showing an example in the case where a skirt portion is wider in the forward, rearward, rightward, and leftward directions, and narrower in directions which are tilted by 45 degrees, and FIG. 13(*c*) is a view showing an example in the case where the skirt portion is thinner in the forward, rearward, rightward, and leftward directions, and thicker in directions which are tilted by 45 degrees.
Figure 13:
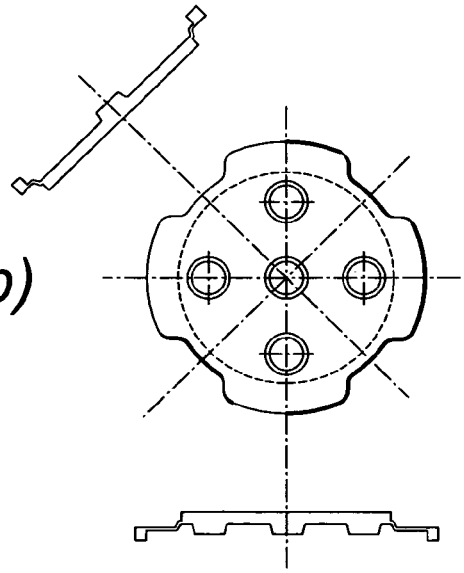
Figure 13:
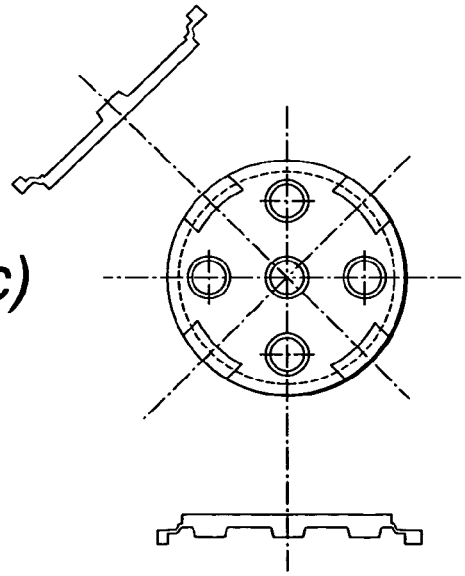

FIG. 13(*a*) is a section view taken along the line A-A of FIG. 5 and showing the configuration of an assembled 5-direction key operating device of a seventh embodiment of the invention. Although the shape of pusher portions 126 is trapezoidal in the same manner as FIGS. 6(*a*), 7, and 12(*a*), a skirt portion is wider in the forward, rearward, rightward, and leftward directions, and narrower in directions which are tilted by 45 degrees in an example of FIG. 13(*b*). By contrast, in an example of FIG. 13(*c*), the skirt portion is thinner in the forward, rearward, rightward, and leftward directions, and thicker in directions tilted by 45 degrees.

In the seventh embodiment of the invention, as described above, the structure of the key skirt portion 129 disposed on a key base 127, particularly the width or thickness of the key skirt portion 129 is adjusted, so that the pushing sensation experienced when the center pusher portion is pressed is made different from that experienced when one of the upper, lower, right, and left pusher portions is pressed.

Figure 14:
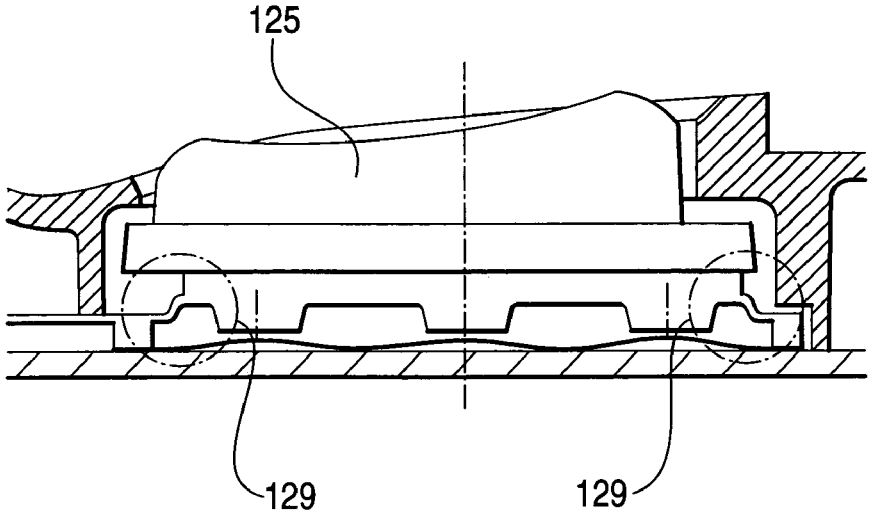
FIG. 14(*a*) is a section view taken along the line A-A of FIG. 5 and showing the configuration of an assembled 5-direction key operating device of an eighth embodiment of the invention, FIG. 14(*b*) is a view showing an example of a shape in which a key skirt portion has less slackening, and FIG. 14(*c*) is a view showing an example of a shape in which the key skirt portion has increased slackening.
Figure 14:
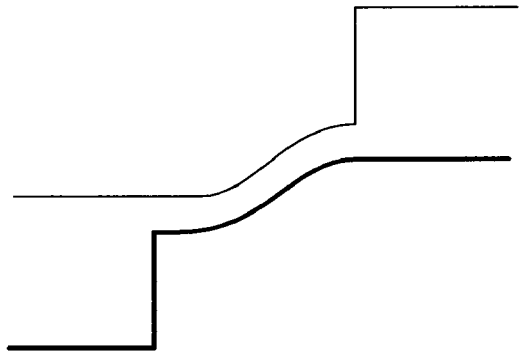
Figure 14:
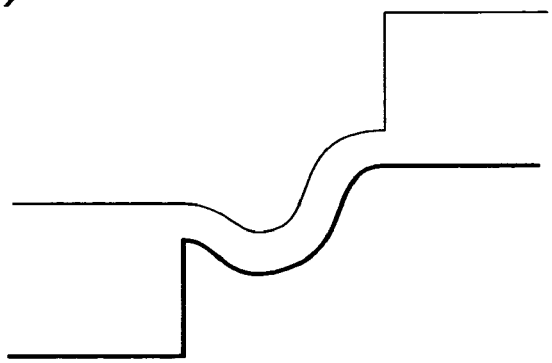

FIGS. 14(*a*) and 15(*a*) are section views taken along the line A-A of FIG. 5 and showing the configuration of an assembled 5-direction key operating device of an eighth embodiment of the invention. Although the shape of pusher portions 126 is trapezoidal in the same manner as FIGS. 6(*a*), 7, and 12(*a*), the shape of a skirt portion 129 disposed on a key base 127 is adjusted, to so that the pushing sensation experienced when the center pusher portion is pressed is made different from that experienced when one of the upper, lower, right, and left pusher portions is pressed.

Specifically, with respect to the shape of the skirt portion 129, portions where the key skirt portion has less slackening as shown in FIG. 14(*b*), and those where the key skirt portion has increased slackening as shown in FIG. 14(*c*) are placed in a different manner in the forward, rearward, rightward, and leftward directions, and in the directions tilted by 45 degrees, as in the cases of FIGS. 13(*b*) and 13(*c*). According to this configuration, the pushing sensation experienced when the center pusher portion is pressed can be made different from that experienced when one of the upper, lower, right, and left pusher portions is pressed.

Figure 15:
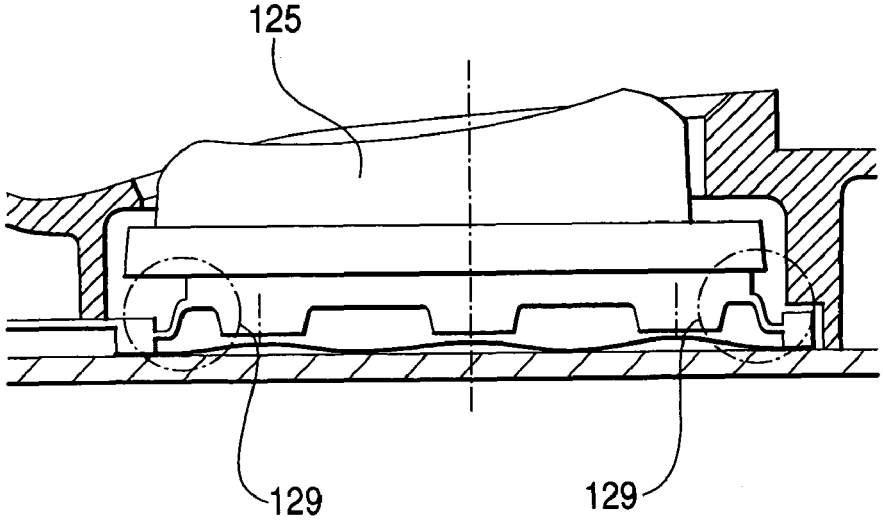
FIG. 15(*a*) is a section view taken along the line A-A of FIG. 5 and showing another configuration of the assembled 5-direction key operating device of the eighth embodiment of the invention, FIG. 15(*b*) is a view showing a first example of a shape in which a position where a key skirt portion starts is shifted, and FIG. 15(*c*) is a view showing a second example of a shape in which the position where the key skirt portion starts is shifted.
Figure 15:
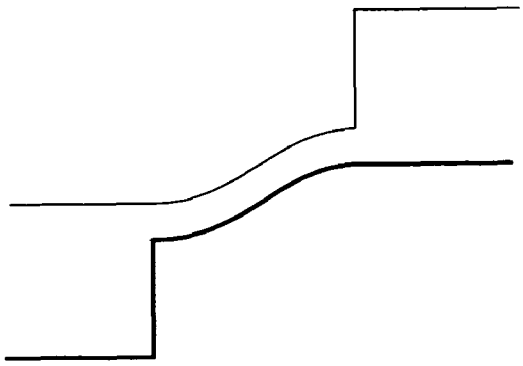
Figure 15:
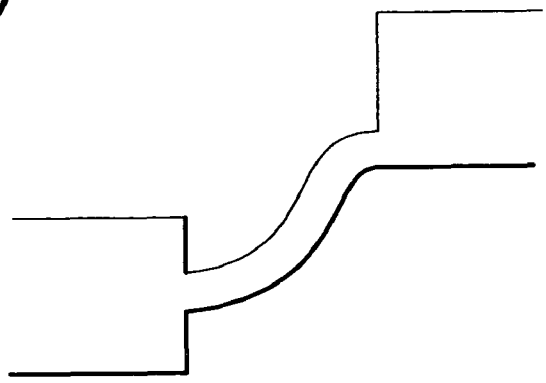

With respect to the shape of the skirt portion 129, as shown in FIGS. 15(*b*) and 15(*c*), shapes in which the position where the key skirt portion starts is shifted are placed in a different manner in the forward, rearward, rightward, and leftward directions, and in the directions tilted by 45 degrees. According to this configuration, the pushing sensation experienced when the center pusher portion is pressed can be made different from that experienced when one of the upper, lower, right, and left pusher portions is pressed.

Figure 16:
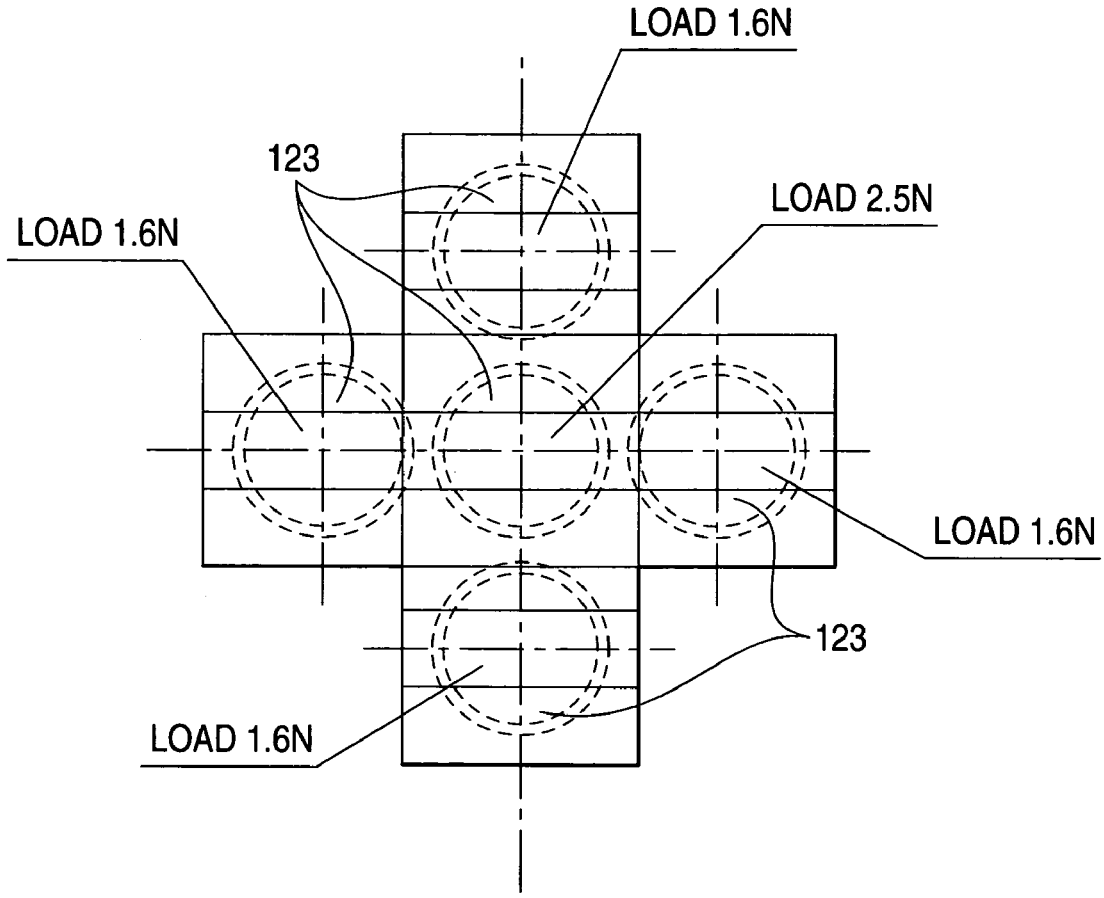
FIG. 16 is a view showing the configuration of diaphragms of a 5-direction key operating device of a ninth embodiment of the invention.
Figure 17:
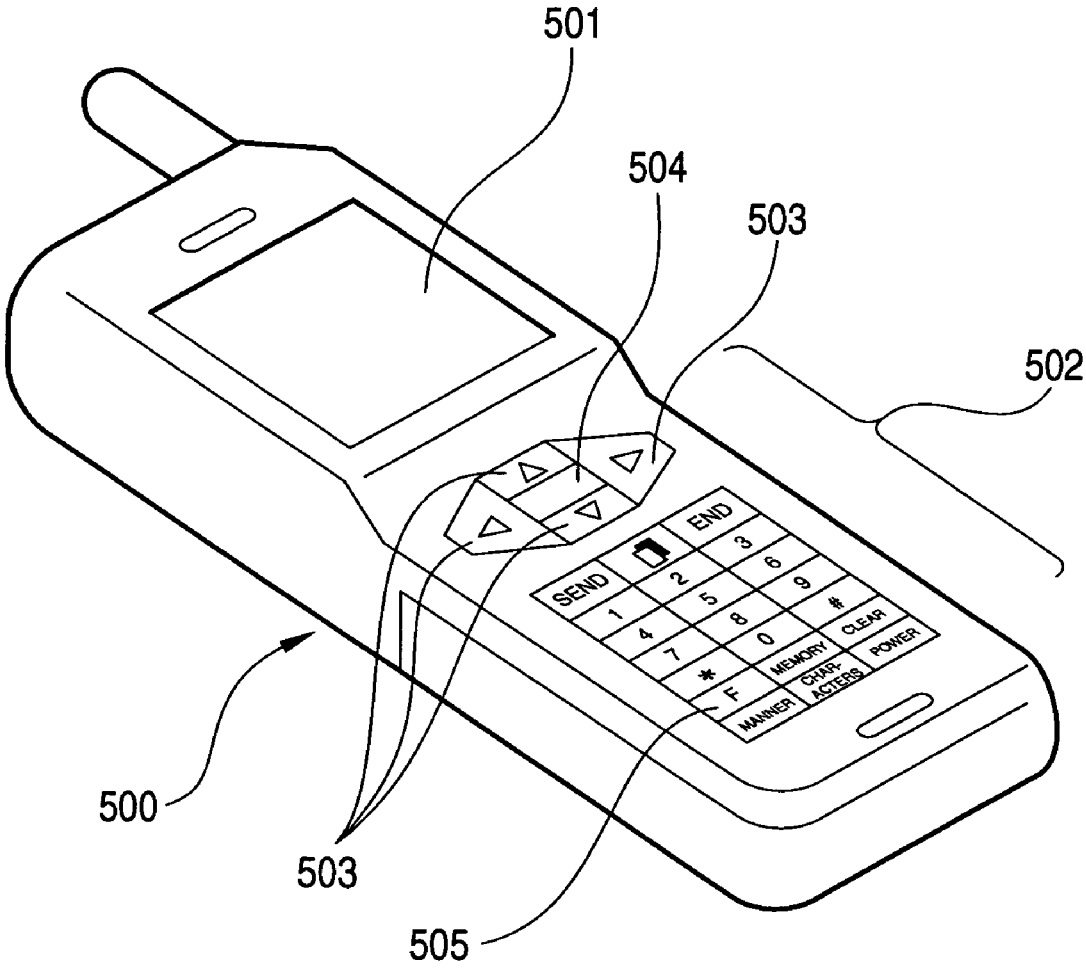
FIG. 17 is a view showing the configuration of a conventional 5-direction key operating device.

FIG. 16 is a section view showing the diaphragm configuration of an assembled 5-direction key operating device of a ninth embodiment of the invention. The embodiment is configured so that five diaphragms 123 are proximately arranged in a shape of a cross, and a load on the center diaphragm is changed from loads on the upper, lower, right, and left diaphragms. In the case of FIG. 16, the load on the center diaphragm is set to 2.5 N, and the load on the upper, lower, right, and left diaphragms is set to 1.6 N, so that the difference is 0.9 N.

According to this configuration, the pushing sensation experienced when the center pusher portion is pressed can be made different from that experienced when one of the upper, lower, right, and left pusher portions is pressed.

The values to which the loads are set are determined by actually setting and then performing key operations at the loads. The values of FIG. 16 are not fixed.

The values of the loads of FIG. 16 are varied also in accordance with the configurations of FIGS. 6(*a*) to 15(*a*). From this viewpoint, the values of loads are not fixed.

INDUSTRIAL APPLICABILITY

As described above, the invention provides a 5-direction key operating device in which diaphragms respectively corresponding to five directions are proximately arranged in a shape of a cross, which includes pushers corresponding to the five directions on a key core face opposed to the diaphragms, and in which a single key is enabled to perform key operations of the five directions, and characterized in that each of diaphragm contacts which are disposed on a printed circuit board opposed to the diaphragms are structured to have a first contact, and at least one second contact surrounding the first contact, at least one strip-like contact portion which are elongated from each of the second contacts to a side opposite to a side of the first contact are disposed in the second contact, and the diaphragm contacts are arranged on the printed circuit board in a shape of a cross correspondingly with the five directions with tilting the strip-like contact portions of the diaphragm contacts by about 45 degrees to vertical and horizontal directions. The invention attains advantages that the diaphragms can be disposed in a minimum space, and that the same button key is enabled to perform key operations of five directions (upper, lower, right, and left+center).

Moreover, according to the invention, a 5-direction key operating device can be provided in which an operation space can be reduced, and desired one of information displayed on a display section can be selected and determined by a smooth key operation without causing an erroneous operation.

The invention claimed is:

1. A 5-direction key operating device in which diaphragms respectively corresponding to five directions are proximately arranged in a shape of a cross, which comprises pushers corresponding to the five directions on a key core face opposed to the diaphragms, and in which a single key is enabled to perform key operations of the five directions, and characterized in that each of diaphragm contacts which are disposed on a printed circuit board opposed to the diaphragms is structured to have a first contact, and at least one second contact surrounding the first contact, at least one strip-like contact portion which are elongated from each of the second contact to a side opposite to a side of the first contact is disposed in the second contact, and the diaphragm contacts are arranged on the printed circuit board in a shape of a cross correspondingly with the five directions with tilting the strip-like contact portions of the diaphragm contacts by about 45 degrees to vertical and horizontal directions.

2. The 5-direction key operating device according to claim 1, wherein the strip-like contact portions are elongated in a fan-like shape with respect to a center of the first contact.

3. The 5-direction key operating device according to claim 1, wherein the strip-like contact portions are rectangular.

4. A 5-direction key operating device characterized in that five diaphragms are proximately arranged in a shape of a cross, pusher portions are disposed on a key core face opposed to the diaphragms, and a structure of a center pusher portion is different from a structure of pusher portions surrounding the center pusher portion.

5. The 5-direction key operating device according to claim 4, wherein a height of the center pusher portion from the diaphragm is different from a height of the surrounding pusher portions from the respective diaphragms.

6. The 5-direction key operating device according to claim 4, wherein a shape of the center pusher portion is different from a shape of the surrounding pusher portions.

7. The 5-direction key operating device according to claim 4, wherein a cross-sectional diameter of the center pusher portion is different from a cross-sectional diameter of the surrounding pusher portions.

8. The 5-direction key operating device according to claim 4, wherein one of a rib and a boss stands from an arbitrary position of the key core face which comprises the pusher portions.

9. A 5-direction key operating device characterized in that five diaphragms are proximately arranged in a shape of a cross, and a structure of a key skirt portion which is formed in a periphery of a key core face opposed to the diaphragms is changed.

10. The 5-direction key operating device according to claim 9, wherein one of a width and thickness of the key skirt portion is changed.

11. The 5-direction key operating device according to claim 9, wherein a shape of the key skirt portion is changed.

12. A 5-direction key operating device characterized in that five diaphragms are proximately arranged in a shape of a cross, and a load on a center diaphragm is changed from loads on surrounding diaphragms.

13. The 5-direction key operating device according to claim 12, wherein pusher portions are disposed on a key core face opposed to the diaphragms, and a structure of a center pusher portion is different from a structure of pusher portions surrounding the center pusher portion.

14. The 5-direction key operating device according to claim 13, wherein one of a rib and a boss stands from an arbitrary position of the key core face on which the pusher portions exist.

15. The 5-direction key operating device according to claim 12, wherein a structure of the key skirt portion which is formed in a periphery of the key core face opposed to the diaphragms is changed.

16. The 5-direction key operating device according to claim 12, wherein pusher portions are disposed on the key core face opposed to the diaphragms, a structure of a center pusher portion is different from a structure of pusher portions surrounding the center pusher portion, and a structure of the key skirt portion which is formed in a periphery of the key core face opposed in the diaphragms is changed.

* * * * *